United States Patent [19]

Britton et al.

[11] 4,259,379

[45] Mar. 31, 1981

[54] APPLICATION OF LIQUID MATERIAL TO WEBS

[76] Inventors: Arthur Britton, 4 The Sycamores, Bramhope, Leeds LS16 9JR, Yorkshire; John C. Smith, 10 Pine Rd., Didsbury, Manchester; Roger I. Davis, 8 Wildcroft Ave., Moston, Manchester; John A. Page, 69 Kingsfield Dr., Manchester, all of England

[21] Appl. No.: 957,369

[22] Filed: Nov. 3, 1978

[30] Foreign Application Priority Data

Nov. 10, 1977 [GB] United Kingdom ..... 46782/77

[51] Int. Cl.[3] ..... B05D 3/12

[52] U.S. Cl. ..... 427/356; 118/125; 118/126; 118/404; 118/405; 118/413; 118/415; 427/365; 427/385.5; 427/394; 427/434.2; 427/434.7

[58] Field of Search ..... 118/405, 404, 413, 415, 118/125, 126; 427/356, 365, 434 R, 434 E, 385 R, 394, 434.2, 434.7, 385.5

[56] References Cited

U.S. PATENT DOCUMENTS

| | | | |
|---|---|---|---|
| 2,127,413 | 8/1938 | Leguillon | 118/405 |
| 2,280,415 | 4/1942 | Larmuth | 118/125 |
| 2,390,780 | 12/1949 | Cornwell | 427/365 |
| 2,952,240 | 9/1960 | Abbott | 118/125 |
| 3,350,248 | 10/1967 | Demarest et al. | 118/405 |
| 3,473,512 | 10/1969 | Wood | 118/125 |
| 3,672,974 | 6/1972 | Tomlinson | 118/405 |
| 3,700,486 | 10/1972 | Veltri et al. | 118/405 |
| 4,064,830 | 12/1977 | Hunter | 118/405 |
| 4,116,159 | 9/1978 | Long | 118/405 |

*Primary Examiner*—Ronald H. Smith
*Assistant Examiner*—Janyce A. Bell
*Attorney, Agent, or Firm*—Fleit & Jacobson

[57] ABSTRACT

Disclosed is an applicator for the application of liquid to webs and methods of using it. A web-guide path is defined through the applicator and has an intermediate enlargement. One or more inlets and one or more outlets are provided at the exterior of the applicator and at the enlargement respectively, which are part of a closed passageway system for the supply of liquid to the enlargement. A slit-like passageway system affords passage of web to the enlargement. An exit passageway with one outlet affords passage of web, to which liquid has been applied, from the enlargement out of the applicator. Means are provided for changing characteristics of the exit passageway whereby selectively to influence the application of liquid to the web. By using such an applicator in which provision is made for changing the size or shape, or both, of the exit passageway, considerable control may be exercised over both the degree of impregnation of the liquid into the web and the thickness of liquid coating on the web.

22 Claims, 7 Drawing Figures

Figure 1:
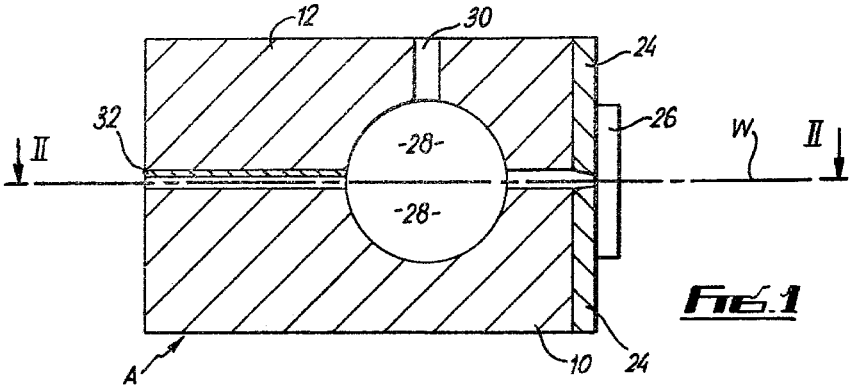

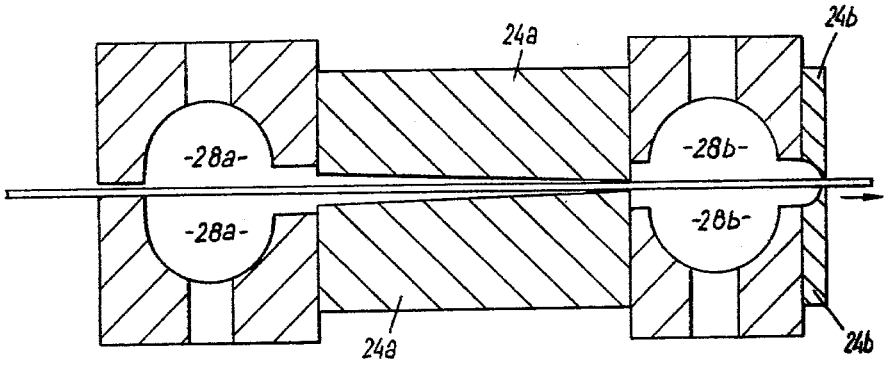
FIG. 6
FIG. 7
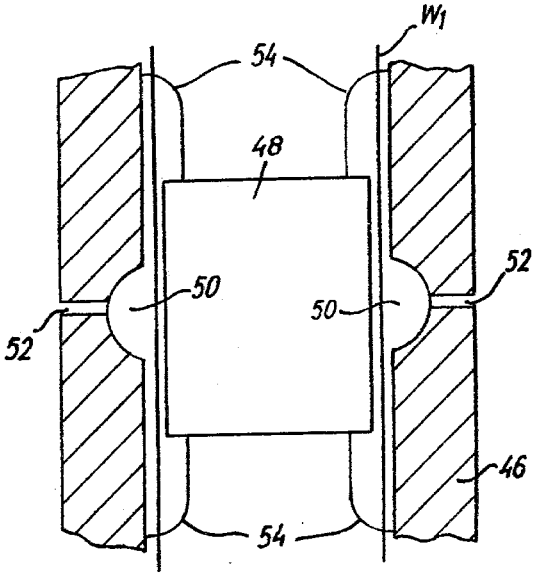

APPLICATION OF LIQUID MATERIAL TO WEBS

This invention concerns the application of liquid material to webs. The term "web" is meant to include any length of flexible material capable of being impregnated or coated, or both, with liquid material. Thus, for example, the web may be formed simply from a large number of warp yarns in side-by-side assembly, or may be a textile or other fabric. The term "liquid" is not intended to be construed in a narrow sense, but to include liquids in general. Thus, for example, it includes solutions, dispersions and suspensions.

There are a number of industrial techniques for applying liquids to webs. Some are pressurised and some are not.

One example of a pressurised system is described in U.K. Pat. No. 1,388,970, which is concerned with the encapsulation of reinforcing filaments within a ribbon of elastomeric material. The elastomeric material is generated in an extruder, and a special cross-head die, through which the filaments pass for encapsulation is fitted to the extruder outlet.

The die has an intermediate internal enlargement fed from the extruder via passageways which are of complicated shape and which are vented preferably in an adjustable manner presumably to prevent the high pressure within the enlargement rising to an undesirable level.

Such a die suffers from the disadvantages that high pressures must be accommodated in the enlargement, and difficulty of control of the application of the elastomeric material, specially of surface coating. Another example of a pressurised system is a pad mangle arrangement. Whilst with such a system good impregnation may be achieved, simultaneous surface coating control is difficult.

Examples of techniques which are open (i.e. not pressurized) are knife coating or spraying techniques.

Generally speaking, a spraying technique allows reasonable control of surface coating, but does not facilitate any control of impregnation. Knife coating techniques are capable of affording reasonable control of either impregnation or surface coating but not of both.

The general objective of the present invention is to provide an applicator for applying liquid to a web which incorporates an essentially low pressure feed system coupled with effective control of the application of the liquid to the web, both so far as impregnation and coating are concerned. No existing technique provides such a combination of features.

According to the present invention an applicator for applying liquid to a web, through which is defined a web-guide path having an intermediate enlargement, to which enlargement liquid may be supplied, is characterised by a first, closed, passageway system which connects the enlargement to the exterior of the applicator for the supply of liquid to the enlargement, a second, slit-like, passageway system affording passage of web to the enlargement, and an exit passageway having a single outlet and affording passage of web, to which liquid has been applied, from the enlargement to the exterior of the applicator, and by means for changing characteristics of the exit passageway whereby selectively to influence application of the liquid to the web material.

By "a closed passageway system", we mean a passageway system which has one or more inlets for liquid and, at the enlargement, one or more outlets for liquid, there being no other inlet or outlet.

Also according to the present invention a method of applying liquid material to a web comprises the steps of passing web through the slit-like passageway system of an applicator or applicator system and conducting liquid material to the or each intermediate liquid receiving enlargement in sufficient quantity to keep same filled.

Figure 2:
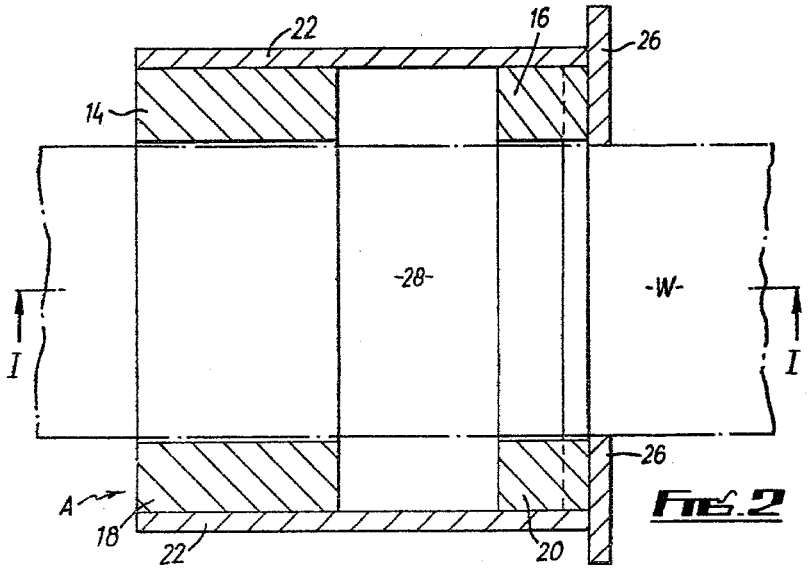
Figure 3:
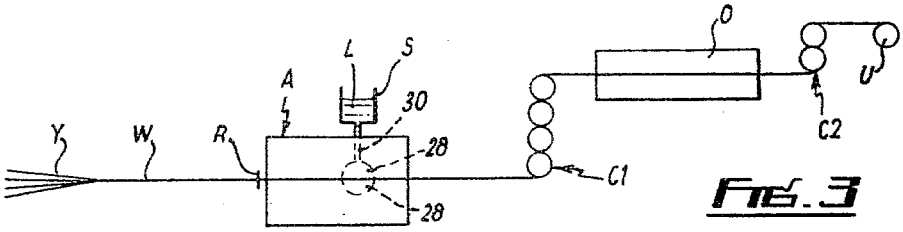
Figure 4:
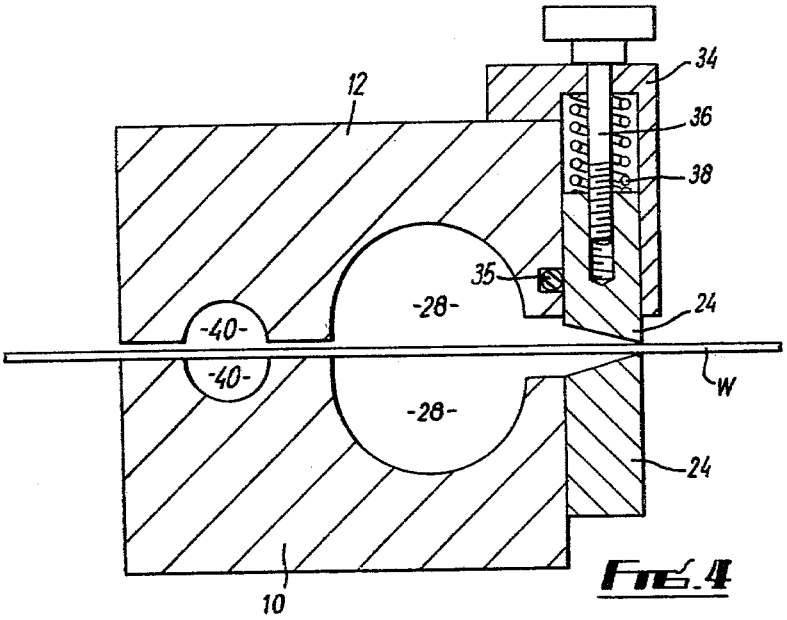
Figure 5:
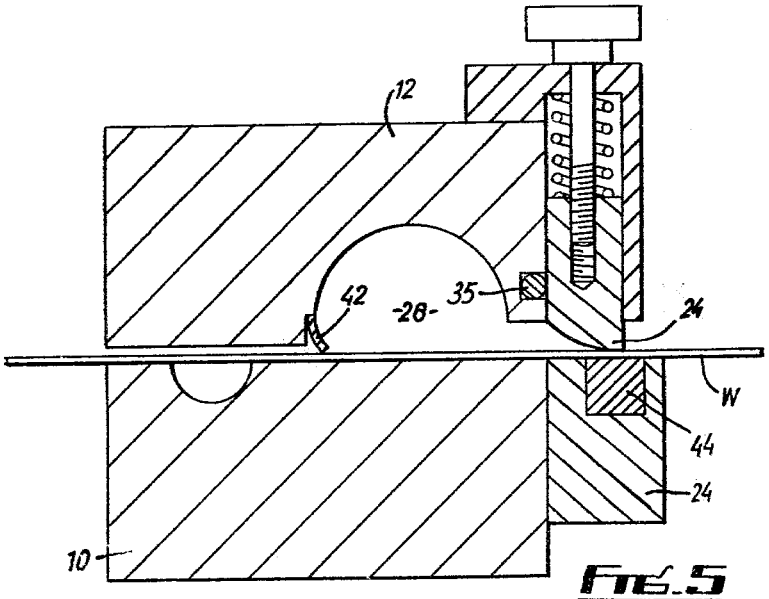

The invention will now be described further, by way of example only, with reference to the accompanying drawings, in which, FIG. 1 is a sectional end elevation on the line I—I of FIG. 2 of an applicator constructed according to the invention, FIG. 2 is a sectional plan view on the line II—II of FIG. 1, and FIG. 3 is a diagram illustrating a web of warp yarns being coated with latex by a process according to the invention and involving the use of an applicator as shown in FIGS. 1 and 2, FIG. 4 is a sectional end elevation similar to FIG. 1, of another applicator constructed according to the invention, FIG. 5 is a sectional end elevation, also similar to FIG. 1, of still another applicator constructed according to the invention, FIG. 6 is a sectional diagrammatic representation of another form of applicator according to the invention, and FIG. 7 is a sectional diagrammatic representation of yet another form of applicator according to the invention.

In co-pending application U.K. Pat. No. 25552/77 is described the manufacture of fabrics, in particular, tyre reinforcing fabrics, from webs of closely-spaced warp yarns which are held together in a matrix of latex and the applicators now to be described are vey suitable for producing such webs. There are of course many other cases when it is desired continously to coat a web in the form of a fabric in the piece, and use of an applicator according to the present invention will often be suitable and advantageous.

Referring first to FIGS. 1 to 3 the applicator A consists basically of a lower block 10 and an upper block 12 secured together but with intervening spacers 14, 16, 18, 20 and fitted with side plates 22, adjustable selected control plates 24 and curtain plates 26, which are also, preferably, adjustable. Each block has formed therein a transverse runnel 28 and in the upper block 12 are a number of supply passageways 30 leading from the top of the block to the runnel therein. A pad 32 of foam rubber or plastics material is provided on the under surface of the rear part of the upper block 12 or on the upper surface of the lower block 10. When assembled (FIGS. 1 and 2) there is defined, through the applicator, a slit-like web-guide path, bounded top and bottom by the blocks 10, 12, pad 32, and control plates 24, and, at the sides by spacers 14, 16, 18, 20 and curtain plates 26, which if adjustable, enable the path width to be varied. The runnels 28 run right across the passageway, together forming a generally cylindrical enlargement the ends of which are closed by the side plates 22. The path of a web W through the applicator is shown in dot-dash line.

FIG. 3 illustrates the treatment of a web W of warp yarns by a method according to the invention. The warps Y of the web W are gathered from a creel (not shown) and pass through a reed R disposed immediately in front of the applicator A (shown in more detail in FIGS. 1 and 2). The passageways 30 in the applicator A are supplied with latex L from one or more supply vessels S and thereby the enlargement formed by the runnels 28 is kept filled with latex to coat both sides of the web W. On emerging from the applicator A, the web W passes around a four-roll heated calendar C1, then through a drying oven O, around traction rollers C2, passing finally to a wind-up U.

It may be found necessary, when coating a web of warp yarns, to design the means for handling the web on emergence from the applicator through to wind up very carefully. For example, there is a tendency, on emergence from the applicator, for the applied latex to be disturbed, and especially for "splitting"—i.e. separation of groups of warp yarns one from the other—to occur. The use of a high quality reed before the applicator reduces splitting, but it has been found desirable also to pass the emergent web through a roll system since this helps to re-establish the coherence of the web if splitting has occurred. However, unless care is taken, calendar systems can themselves cause different kinds of disturbances of the latex such as "stringing"—i.e. adherence of latex to a roll surface as the coated web leaves it—and displacement of the web relative to the latex giving uneven coatings on the two sides. To avoid or minimise these disturbances it has been found desirable to ensure that the web moves at a different linear speed from the linear speed of the roller surfaces with the coated web passing round them in convolutions such as shown in FIG. 3. Actually, in practice, provided the calendering rollers are maintained at a sufficiently high temperature, and provided that the latex is so formulated as to have a high gelling ability, few, if any, problems are experienced due to splitting and stringing.

The oven may be for example a micro-wave or infrared oven, but air drying in a hot enclosure is not precluded.

It has been found possible to exercise considerable control over the coating operation, most importantly by varying the shape and configuration of the passageway which affords passage to web leaving the enlargement 28. In the embodiment being described these may be varied by suitably selecting and adjusting the control plates 24.

Some control may also be exercised by varying the head of the supply of coating liquid, the tension applied to the web passing through the applicator, and the take-off angle of the web.

It will often be that plates 24 shaped to form a convergent nozzle as shown in FIG. 1 are very suitable. The thickness of the plates 24 may be selected according to the desired effect of the liquid head, since the longer the nozzle the less will be the effect of the latter.

As to the head, increasing it, will, in general, tend to increase the coating weight and vice-versa. Thus it may be possible for the system to be self-controlling, so far as applied amount of liquid for unit length of web is concerned, by feeding supply vessels with coating material metered at the desired rate of take-up. If the web is taking up too much or too little material the head will drop or rise as the case may be and so therefore will the rate of take-up of material by the web decrease or increase. Alternatively change in level could be detected and used to control some characteristic of the liquid material to correct the rate of application—e.g. viscosity of dilution (though dilution would not be a desirable characteristic to alter in the case of latex).

As to the web tension, if this is properly selected the viscous forces at the passageway outlet tend to centralise the web in the gap between the control plates to give equal coatings on both sides.

As to the web take-off angle, a controlled doctoring effect can be achieved.

The invention is by no means limited to the details of the embodiment just described with reference to FIGS. 1 to 3 of the accompanying drawings. In that embodiment like runnels 28 are provided in each block 10, 12. However, the runnels need not be of the same shape and size. Indeed in some cases there need be a runnel only in the upper block, as for example if the coating of one side only of an impervious web is required, or, indeed, for applying material to many types of warp sheet, if the nature of the sheet is such that the latex or other coating material can pass readily therethrough. Furthermore there may be embodiments in which more than one intermediate enlargement is provided, perhaps for more than one liquid material to be applied to the web or for certain types of "wet-on-wet38 processes as will later be described. The form rubber pad 32 is not essential because the web as it moves into the applicator continuously urges back into the cavity 28 any liquid tending to leak out contrary to the motion of the web. The form pad is however useful in preventing any contact between air and the liquid where it is necessary to prevent evaporation or oxidation. As an alternative to the rubber pad, air saturated with solvent vapour may be introduced into the passageway, thereby preventing evaporation. In the case of liquids which react with air, an unreactive gas, such as nitrogen, may be similarly introduced. The control plates 24 may be profiled solid bars as shown in the drawings, but in some embodiments at least one may be in the form of a blade of a compliant nature capable of giving way to allow passage of any lumps or the like which might be inadvertently present in the liquid material or in the web. Another alternative would be to provide adjustable members in the form of inflatable tubes, with or without rigid internal support bars. Control plates could take the form of a U-section lower piece and a corresponding T-section upper piece with the web passing straight between so that they touch both the tops of the U-section and the base of the T-section. The tension and close proximity of warp ends of a web may prevent any unacceptable leakage of fluid, but the space in the U-section would permit knots and the like to pass through. It may, however, be desirable to insert within the U-section, or bridge it by, a flexible member which contacts the warp ends to make certain of no leakage of fluid. In some embodiments, the outer leg of the U-section may become superfluous.

The supply vessel may be connected to applicator by flexible conduits to allow the applicator to gimballed if required. In some processes it may be necessary or desirable to heat or to cool the applicator, for example to control the viscosity of the applied liquid, and in this event suitable heating elements or cooling tubs and suitable control means will be incorporated in the applicator.

In some processes (as will later be described) it may be desirable to coat a web in two stages by passing it through one applicator according to the invention, and then through another, and the latex first applied may not be very viscous. In order to prevent leakage it may be desirable to contour the opposed edges of the control plates 24 (or one of those edges) so as individually to control the passage of each warp end. Although reference has been made to coating a single sheet of warp end, other assemblies of warp ends may be involved. For example an assembly of rather more three-dimensional form may be processed. Again such an assembly may be of a generally random, or of a non-random nature. In the latter case more than one entry passageway leading to the enlargement may be provided for the introduction of several warp sheets.

When the coated material is to be stentered it is desirable that its edges be left free or be starved of coating material so that the stenter pins or clips do not become fouled.

This can be achieved by blocking off the runnels 28, or by specially contouring the control plates, or both.

Turning now to FIGS. 4, 5 and 6 of the drawings, parts corresponding to parts of the applicator of FIGS. 1 to 3 have been given the same reference numerals. In each case the general construction is similar, and therefore only a sectional end view is provided.

FIG. 4 illustrates an applicator having runnels 28 in both blocks 10, 12, like the applicator of FIGS. 1 to 3. The runnels however are of a slightly different shape, and extend towards the control plates 24 to provide a parallel commencement to the convergent nozzle formed by the latter.

The lower control plate 24 is normally fixed, once set. The upper control plate 24 however is readily adjustable, being slidably mounted in a housing 34 on a lead screw 36 which is externally adjustable against the action of a compression spring 38. The spring 38 prevents back-lash on adjustment, and also enables the top plate 24 to yield if say a lump of coating material occurs, or a thick material joint is present. A seal 35 is accommodated in the top block 12.

The applicator blocks 10, 12 also have channels 40 (their dimensions are smaller than those of the runnels 28). Where latex is the coating material these channels 40 will be supplied with and saturated with water vapour in order to discourage the formation of a skin on the latex. Where a solvent-based coating is being applied then the appropriate solvent vapour could be fed to the channels 40.

The applicator of FIG. 5 is suitable for coating one side only of the web W, or both sides of the web W if it is a warp sheet of suitable characteristics. There is a runnel 28 in the upper block 12 only. In this embodiment a sealing flap/42 prevents contact between air in the entry passage and the coating material in the runnel 28; and the lower control plate 24 is provided with a resilient insert 44 further to accomodate the passage of lumps, knots, joints and the like between the two control plates 24.

Mention has been made earlier of applicators according to the present invention suitable for certain types of "wet-on-wet" processes and for coating a web in two stages. The applicator illustrated in FIG. 6 is an example. It is intended for coating heavy fabrics as in the production of polyvinyl chloride coated conveyor belts where the carcass is a heavy, closely woven fabric which must be well penetrated and have a substantial coating built upon each side. In such demanding processes it is desirable to use two applicators according to the invention in tandem and such an arrangement is illustrated in FIG. 6.

The first applicator is of the same general construction as before, having runnels **28*a* and elongated control plates 24*a* defining a long convergent passageway which leads to the second applicator which has runnels 28*b* and control plates 24*b*** which close the otherwise parallel-walled exit passageway quite abruptly with knife edges.

In operation, the first applicator exerts, in the passageway, defined by the control plates **24*a*, increasingly high pressure in the PVC in liquid form which has been taken up by the web W in passing through the enlargement formed by the runnels 28*a* thus forcing that liquid well into the web interstices. The thus impregnated web then passes through the second applicator where it picks up further PVC in liquid form. However the control plates 24*b***, according to the spacing of their opposed edges, now control the add-on of PVC at both sides of the already impregnated web.

In this manner a well-impregnated heavily coated and product results.

Finally FIG. 7 illustrates diagrammatically an annular applicator according to the invention for coating an tubular web W1. It consists of a annular body 46 and an internal former 48. The body has an annular runnel 50 with feed passages 52 for coating material. The former would need to be magnetically supported if the coating of say a woven or knitted fabric were involved, but wire supports 54 could be employed if a tubular arrry of warps was being coated.

In all the embodiments described the coating or impregnating of the web could be encouraged by the provision of a steam box just prior to the entry side of the applicator so that the web would be steam purged just as it moves into the applicator. The steam condenses during the passage of the web towards the runnel or runnels which tends to give rise to a vacuum in the interstitial spaces of the web so encouraging the impregnation and coating action. In some cases steam would be unsuitable and a different vapour would be used.

The invention has numerous applications apart from the impregnating and coating on both sides of a sheet or web of warp yarns with latex. For example it is frequently necessary in manufacturing to coat textile fabrics with various liquids which are later dried and solidifed, as in the manufacture of conveyor belting and waterproof materials. Paper also sometimes needs to be coated. As coating materials may be mentioned by way of example not only latex but polyvinyl chloride, polyurethane, and acrylic and epoxy resins.

When coating with polyvinyl chloride a standard PVC plastisol formulation could be used, incorporating at least a base polymer, plasticiser, filler, stabilisers, antistatic agent and pigment, either with or without an isocyanate or other bonding agent.

Another important anticipated use of the invention is to make structural material which can replace structural material which is presently made from asbestos, regarded in many forms as a health hazard. The web to be coated consists of a fibrillated polypropylene film and the coating or encapsulating material is a cement sherry. Preferably several such webs will be coated with the sherry and laid one on the other before the cement hardens. In a particular example of this use of the invention may be envisaged continuous production and utilisation of such a coated web for lining culverts and the like. Also embodiments in which the applicator, rather than the web, moves can be foreseen.

According to one specific example a tarpaulin is made from a fabric woven from 940 d/tex continuous filament nylon yarn type 126 manufactured by I.C.I. Limited, and having no twist, 22 ends per inch and 22 picks per inch, of weight 5.1 ozs. per square yard which is passed through an applicator similar to that shown in FIG. 4 but without the runnels 40. A PVC plastisol is supplied to the runnels 28. The plastisol comprises a PVC polymer, plasticiser, filler, stabilisers, antistatic agent and pigment, together with an ISO cyanate bonding agent.

By suitably adjusting the member 24 an applied weight of 7 oz. per square yard with good penetration and a coating of slightly greater thickness on one side than the other was achieved.

Among the advantages of the invention are the total enclosure of the coating region which prevents the undue release of noxious fumes when present, and facilitates a clean process; the controllability of the application of the liquid material; the fact that both sides of a web may be simultaneously coated; and that, provided the coating substance is sufficiently viscous, the applicator can be used in any orientation as its operation would be largely uninfluenced by gravity (though an applicator according to the invention can be arranged to operate by gravity feed). However, perhaps the main advantage of the invention is that it facilitates, in a particularly efficacious manner, the application of relatively thick coatings, or deep and thorough penetration, or both.

We claim:

1. An applicator for applying liquid to a web comprising a pair of solid blocks juxtaposed together with one block above the other defining an entrance end and an exit end, at least the bottom surface of the top block defining a recess located nearer to the exit end of said juxtaposed blocks, said recess extending transverse to the path of a web travelling through the applicator a distance at least equal to the width of the web being treated, a bore communicating the recess with a reservoir of coating liquid, first means for holding the pair of blocks spaced apart in the vertical direction and for defining an inlet passageway correlated with the width of the web to be coated, said inlet passageway extending from said recess to the entrance end of said juxtaposed blocks, exit means defining an exit from said recess to said exit end of said juxtaposed blocks, at least one doctor blade mounted on an end of said top block at said exit means to bear on a web exiting therefrom and having a width to extend transverse to said exit means, and side curtain means mounted against the end portions of the doctor blade to reduce the width of the doctor blade so that the coating operation can be conducted with the recess completely filled with coating liquid whereby precise thicknesses of coating can be applied to the surface of the web or impregnated thereinto in a substantially sealed enclosure.

2. An applicator as claimed in claim 1, wherein said exit means includes members, one at least being adjustable, which define at least some of the dimensions of the exit.

3. An applicator as claimed in claim 2 in which said members are adjustable plates defining contours of at least part of the transverse walls of the exit.

4. An applicator as claimed in claim 2 in which said members comprise two plates mounted with respective longitudinal edges facing each other, so as to adjustably define transverse boundaries of the outlet end of the exit.

5. An applicator as claimed in claim 4 in which one of the plates is resiliently urged towards the other plate.

6. An applicator as claimed in claim 4 in which one of the facing edges is narrower than the other, the wider edge having, at a location opposite the narrower edge, a recess which accommodates, or is bridged by, a flexible member.

7. An applicator as claimed in claim 1 in which the top surface of the bottom block has a recess defined therein, the recess extending transverse to the path of a web travelling through the applicator a distance at least equal to the width of the web being treated.

8. An applicator as claimed in claim 1 in which said recess is provided on one side only of said web path.

9. An applicator as claimed in claim 1 in which the outlet end of said exit is in the form of a covergent nozzle.

10. An applicator as claimed in claim 1 further comprising means for feeding said coating liquid to said recess at a rate of take-up by the web, and means for controlling the rate of take-up.

11. An applicator as claimed in claim 1 further comprising means for isolating coating liquid conducted to said recess from ambient conditions surrounding said applicator.

12. An applicator as claimed in claim 11 comprising a further recess enlargement extending across the entire width of said inlet passageway in advance of the first-mentioned recess, and means for supplying same with gas or vapour.

13. An applicator as claimed in claim 1 comprising at least one further recess following said first-mentioned recess, and means for conducting coating liquid thereto.

14. An applicator as claimed in claim 13 in which said first-mentioned recess is to one side of a plane including said inlet passageway, and said further intermediate enlargement is to the other side of said passageway.

15. An applicator as claimed in claim 1 in which said inlet passageway affords passage to more than one web.

16. An applicator as claimed in claim 1 in which said inlet passageway is of generally annular configuration in cross-section.

17. An applicator according to claim 7, further comprising a bore formed in the bottom block for communicating the recess in the bottom block with a reservoir of coating liquid.

18. A method of applying liquid to a web comprising:

passing a web through a pair of solid blocks juxtaposed together with one block above the other defining an entrance end and an exit end, at least the bottom surface of the top block defining a recess located nearer to the exit end of said juxtaposed blocks, said recess extending transverse to the path of a web travelling through the applicator a distance at least equal to the width of the web being treated, a bore communicating the recess with a reservoir of coating liquid;

introducing liquid through said bore into said recess;

holding the pair of blocks spaced apart in the vertical direction to define an inlet passageway correlated with the width of the web to be coated, said inlet passageway extending from said recess to the entrance end of said juxtaposed blocks;

and to define an exit from said recess to said exit end of said juxtaposed blocks;

mounting at least one doctor blade on an end of said top block at said exit end to bear on a web exiting therefrom and having a width to extend transverse to said exit means; and mounting side curtain means against the end portions of the doctor blade to reduce the width of the doctor blade so that the coating operation can be conducted with the recess completely filled with coating liquid whereby precise thicknesses of coating can be applied to the surface of the web or impregnated thereinto in a substantially sealed enclosure.

19. A method as claimed in claim 18, further comprising heating the coated web in a treatment oven.

20. A method as claimed in claim 18, further comprising hot calendering the coated web.

21. A method as claimed in claim 18 in which the coating liquid is latex.

22. An applicator for applying liquid to a web comprising first and second solid blocks juxtaposed together with one block above the other defining an entrance end and an exit end, at least the bottom surface of the top block defining first and second recesses, with the second recess located nearer to the exit end of said juxtaposed blocks, said recesses extending transverse to the path of a web travelling through the applicator a distance at least equal to the width of the web being treated, bores communicating each of the recesses with a reservoir of coating liquid, first means for holding the blocks spaced apart in the vertical direction and for defining a first inlet passageway correlated with the width of the web to be coated, said first inlet passageway extending from the first recess to the entrance end of said juxtaposed blocks, first exit means defining an exit from the first recess, said exit establishing fluid communication between the first and second recesses, second exit means defining an exit from the second recess to said exit end of said juxtaposed blocks, at least one doctor blade mounted on said exit end of said top block of said juxtaposed blocks at said second exit means to bear on a web exiting therefrom and having a width to extend transverse to said second exit means, and side curtain means mounted against the end portions of the doctor blade to reduce the width of the doctor blade so that the coating operation can be conducted with both recesses completely filled with coating liquid whereby precise thicknesses of coating can be applied to the surface of the web or impregnated thereinto in substantially sealed enclosures.

* * * * *